US007061192B2

(12) United States Patent
Ito

(10) Patent No.: US 7,061,192 B2
(45) Date of Patent: Jun. 13, 2006

(54) SWITCHING-TYPE VERTICAL DEFLECTION OUTPUT CIRCUIT

(75) Inventor: Toru Ito, Saitama (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 11/089,036

(22) Filed: Mar. 25, 2005

(65) Prior Publication Data

US 2005/0212464 A1 Sep. 29, 2005

(30) Foreign Application Priority Data

Mar. 25, 2004 (JP) ..... 2004/089878

(51) Int. Cl.
*G09G 1/04* (2006.01)

(52) U.S. Cl. ..... 315/371; 315/368.18; 315/368.19; 348/806

(58) Field of Classification Search ..... 315/371, 315/368.19
See application file for complete search history.

(56) References Cited

U.S. PATENT DOCUMENTS 4,322,663 A * 3/1982 Rilly ..... 315/408
5,929,574 A * 7/1999 Kim et al. ..... 315/370

FOREIGN PATENT DOCUMENTS

JP 9-181932 A 7/1997

OTHER PUBLICATIONS

STMicroelectronics, Class D Vertical Booster, STV9380-Circuit Description, Dec. 2000; pp. 1-13.
STMicroelectronics, STV9380/S, Class-D Vertical Deflection Amplifier For TV And Monitor Application (Version 3.0); Mar. 2002; pp. 1-8.

* cited by examiner

*Primary Examiner*—David Vu
(74) *Attorney, Agent, or Firm*—Pillsbury Winthrop Shaw Pittman LLP

(57) ABSTRACT

A switching-type vertical deflection output circuit comprises: an output-stage circuit constituted of first and second diodes and first and second switching elements, a smoothing circuit, a vertical deflection coil, a reference vertical sawtooth voltage generation unit, a voltage conversion unit of a vertical deflection current, an error voltage generation unit which obtains an error voltage between the reference vertical sawtooth voltage and the conversion voltage of the voltage conversion unit, a drive unit, and a pump-up circuit which pumps up a power-supply voltage to be supplied to the output-stage circuit during the flyback period. The vertical deflection waveform is stabilized by applying a pump-up pulse of the pump-up circuit to the feedback input terminal through an impedance circuit.

11 Claims, 5 Drawing Sheets

FIG.2A V.SAW
FIG.2B $V_{Ly}$
FIG.2C $V_A$
FIG.2D $V_B$
FIG.2E $V_C$
FIG.2F $V_D$
FIG.2G $V_E$
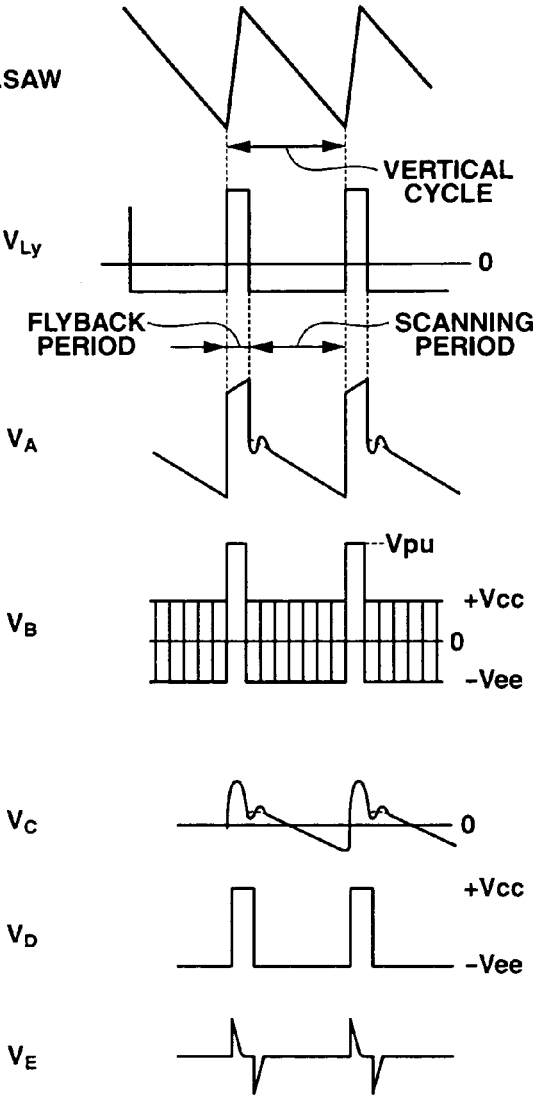
FIG.3
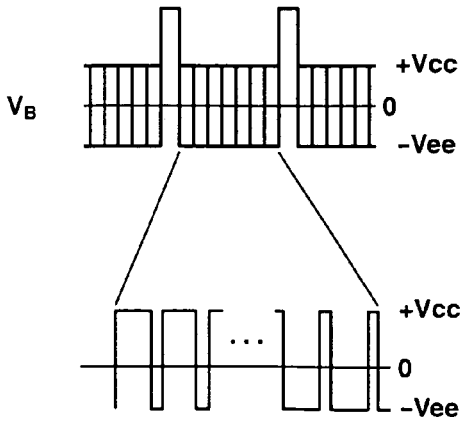

FIG.4A $V_A$
FIG.4B $I_{Ly}$
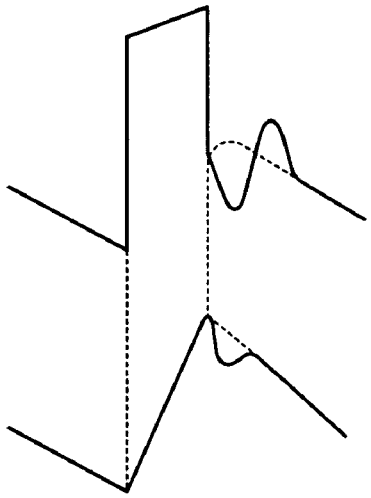
FIG.5
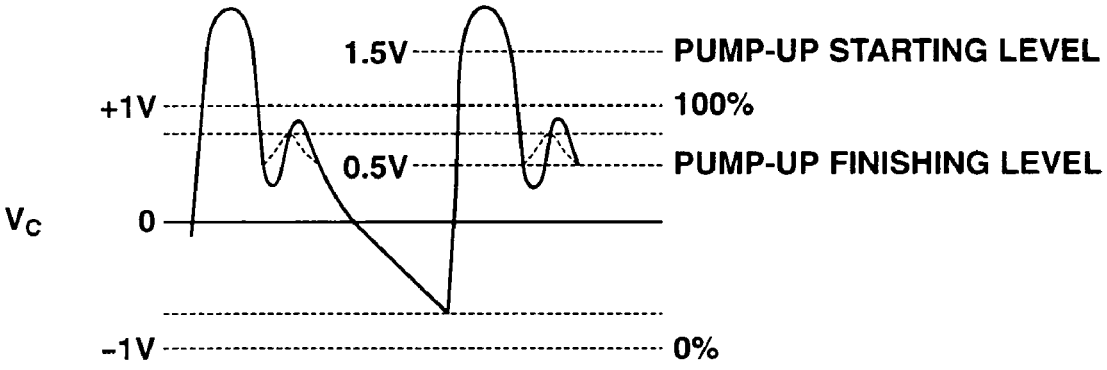

SWITCHING-TYPE VERTICAL DEFLECTION OUTPUT CIRCUIT

CROSS-REFERENCE TO RELATED APPLICATIONS

This application is based upon and claims the benefit of priority from the prior Japanese Patent Application No. 2004-89878 filed on Mar. 25, 2004; the entire contents of which are incorporated herein by reference.

BACKGROUND OF THE INVENTION

1. Field of the Invention

The present invention relates to a switching-type vertical deflection output circuit having a pump-up circuit added to the switching-type vertical deflection output circuit in the vertical deflection circuit of television receivers and other devices using a cathode ray tube.

2. Description of the Related Art

Generally, in vertical deflection output circuits mounted in television receivers, etc., after a sawtooth voltage generated in a vertical oscillation circuit has been shaped and amplified in a vertical drive circuit, it is further amplified in a vertical deflection output circuit to output a vertical deflection sawtooth current to a vertical deflection coil. Then, a magnetic field is generated in an image receiving tube by supplying the sawtooth current to the vertical deflection coil and an electron beam is deflected upward and downward. In the vertical deflection circuit, the vertical deflection output circuit which supplies the amplified sawtooth current to the vertical deflection coil is important in displaying normal images on the image receiving tube.

In recent years, there is a tendency to construct the vertical deflection circuit by using a switching-type amplifier from the view point of operation efficiency. This is because the operation efficiency of the switching-type amplifier is theoretically 100%, and thus, the amplifier has a high operation efficiency.

On the other hand, in the vertical deflection circuit of television receivers using a cathode ray tube, a so-called pump-up circuit, in which, in order to shorten the flyback period, the power-supply voltage is increased only during the flyback period, is widely used. As a vertical deflection output circuit which is already commercially available, for example, a pump-up circuit is incorporated in a semiconductor integrated circuit STV9380 manufactured by STMicroelectronics.

In the switching-type vertical deflection output circuit, when a pump-up circuit is added, there is a problem that disturbance is caused in the vertical deflection output waveform when switched from the flyback period to the scanning period.

A switching-type vertical deflection output circuit in which, even if a pump-up circuit is added, disturbance is not caused in the vertical deflection output waveform when switched from the flyback period to the scanning period has been proposed.

For example, in Japanese Unexamined Patent Application Publication No. 9-181932, the above problem is solved as described below: In order to dissolve disturbance in the waveform right after the pump-up period in a switching-type vertical deflection output circuit, an optimal control is performed so that the end of the pump-up period may be delayed for a fixed time by using a monostable multivibrator circuit.

However, in the integrated circuit in which a pump-up circuit is already used in the vertical deflection circuit, there are cases where it is difficult to alter the pump-up circuit itself, as described in Japanese Unexamined Patent Application Publication No. 9-181932.

BRIEF SUMMARY OF THE INVENTION

It is an object of the present invention to provide a switching-type vertical deflection output circuit in which the waveform can be improved by adding a simple circuit.

A switching-type vertical deflection output circuit according to an aspect of the present invention comprises an output-stage circuit in which the anode of a first diode is connected to the cathode of a second diode, the cathode of the first diode is connected to a first power supply, the anode of the second diode is connected to a second power supply as a reference potential or a low potential including negative voltage, and first and second switching elements are connected in parallel to the first and second diodes, respectively; a smoothing circuit which smoothes the voltage at the connection point of the first and second switching elements; a vertical deflection coil to which a smoothed voltage is supplied from the smoothing circuit; a unit which generates a sawtooth voltage as a reference; a voltage conversion unit which converts a current flowing in the vertical deflection coil to a voltage; an error voltage generation unit which generates an error voltage between the vertical sawtooth voltage and a voltage converted by the voltage conversion unit thereto; a drive unit which controls the on/off operation of the first and second switching elements in the output-stage circuit by generating a drive pulse of a duty ratio in accordance with the error voltage from the error voltage generation unit; a pump-up circuit which pumps up the power-supply voltage of the first power supply to be supplied to the connection point of the first switching element and the cathode of the first diode in the output-stage circuit during the flyback period by detecting the level of the error voltage from the error voltage generation unit; and an impedance circuit which supplies a pump-up pulse generated based on the pump-up operation of the pump-up circuit to an input terminal for the conversion voltage from the voltage conversion unit in the error voltage generation unit.

According to an aspect of the present invention, the impedance circuit is, for example, a series circuit of a capacitor and a resistor.

A vertical deflection drive circuit for operating a vertical deflection coil, comprises a unit which converts a current flowing in the deflection coil to a voltage, a generation unit which generates an error voltage between a voltage of an input saw-tooth signal and the coil voltage, a drive unit which generates a drive pulse of a duty ratio in accordance with the error voltage, an output circuit which is connected to a power supply and produces a drive signal in accordance with the drive pulse, a pump-up circuit which pumps up a voltage of the power supply to be supplied to the output circuit during a fly back period, a superpose circuit which supplies a pump-up pulse which is generated by the pumped up voltage to the generation unit together with the coil voltage.

According to the present invention, an adverse effect on the feedback loop right after the pump-up period by the disturbance component can be reduced by applying a pump-up pulse to the feedback input of an error amplifying unit through the impedance circuit.

BRIEF DESCRIPTION OF THE DRAWINGS

FIG. 2A shows the waveform of a reference sawtooth voltage V.SAW and its vertical cycle in FIG. 1;

FIG. 2B shows the waveform of a voltage $V_{Ly}$ between both ends of a vertical deflection coil $L_y$ in FIG. 1;

FIG. 2C shows the waveform of a voltage $V_A$ at middle point A in FIG. 1;

FIG. 2D shows the waveform of a voltage $V_B$ at point B in FIG. 1;

FIG. 2E shows the waveform of a voltage $V_C$ at output point C of an error amplifier in FIG. 1;

FIG. 2F shows the waveform of the voltage $V_D$ of a pump-up pulse generated at the terminal 6 of an integrated circuit in FIG. 1;

FIG. 2G shows the waveform of a voltage $V_E$ at output point E of an impedance circuit in FIG. 1;

FIG. 3 shows an enlarged part of the waveform in FIG. 2D;

FIG. 4A shows an enlarged part of the waveform of the voltage $V_A$ at middle point A shown in FIG. 2C;

FIG. 4B shows an enlarged part of the waveform of a vertical deflection current $I_{Ly}$ flowing through a vertical deflection coil $L_y$;

FIG. 5 is the waveform in FIG. 2E, which is enlarged;

DETAILED DESCRIPTION OF THE INVENTION

The embodiments of the present invention are described with reference to the drawings.

Figure 1:
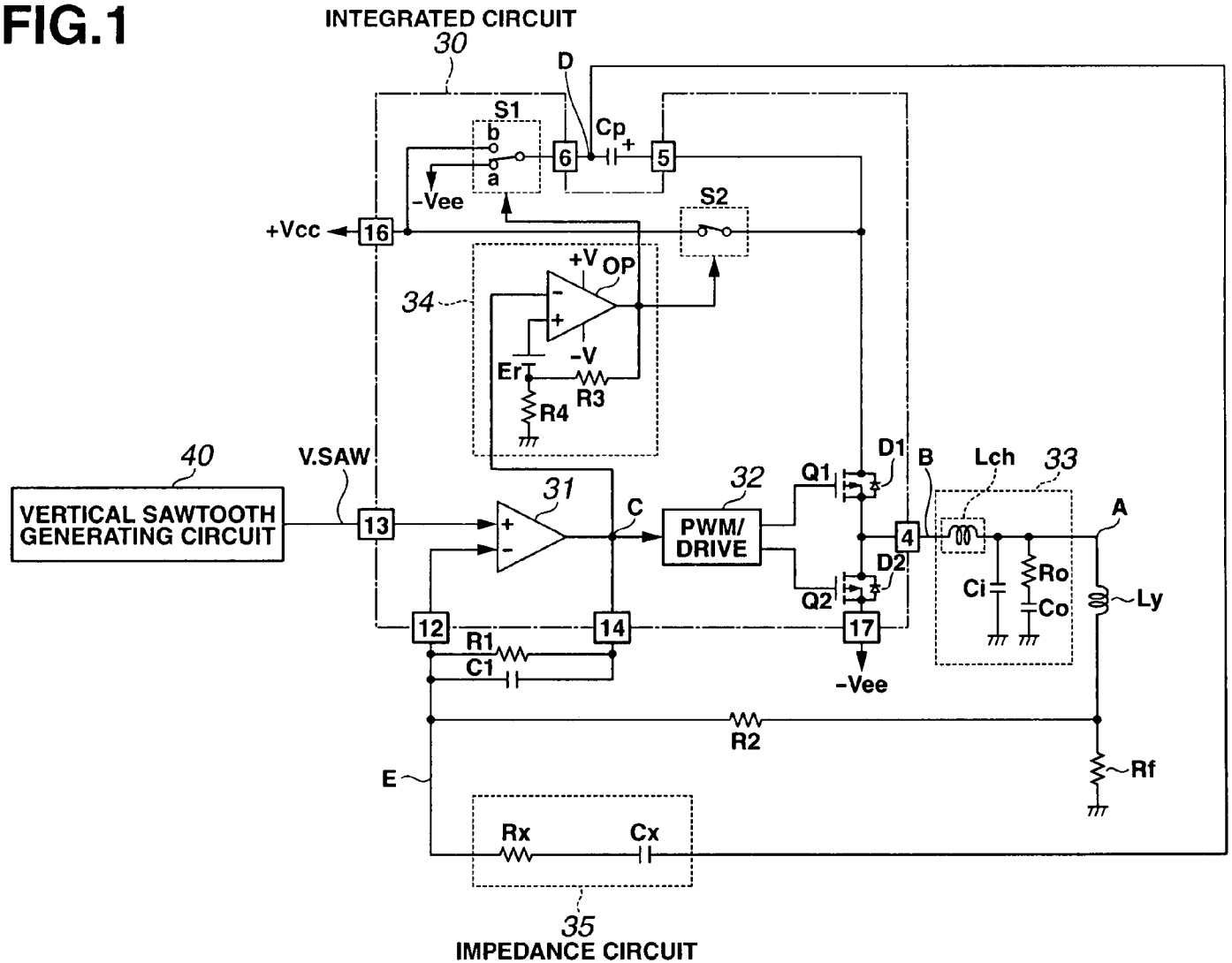
FIG. 1 is the circuit diagram of a switching-type vertical deflection output circuit of an embodiment of the present invention.

FIG. 1 shows the circuit diagram of a switching-type vertical deflection output circuit of an embodiment of the present invention.

In FIG. 1, the portion shown by an alternate long and short dash line is a vertical deflection output circuit composed of an integrated circuit 30, and figures enclosed in a square (16, etc.) represents terminal numbers provided in the integrated circuit 30. Moreover, when a class-AB amplification output-stage circuit (containing Q1, D1, Q2, and D2) is used as a vertical deflection output circuit, since the power-supply voltage in the scanning period is suppressed to be low, there is an effect of reducing the power loss in the output-stage circuit. When a switching-type vertical deflection output circuit based on a class-AB amplification television receiver is introduced, provision of a pump-up circuit has an advantage that the impedance of the deflection yoke, the specification of the power-supply circuit, and others can be changed in a relatively small range. The integrated circuit 30 in FIG. 1 is also provided with a pump-up circuit. As the integrated circuit 30, for example, a semiconductor integrated circuit STV9380 produced by STMicroelectronics, etc., can be used.

The switching-type vertical deflection output circuit shown in FIG. 1 is an SRPP (Shunt Related Push Pull) type vertical deflection output circuit which is constructed by combination of two MOS transistors. The output-stage circuit is composed of first and second diodes D1 and D2 (also called damper diodes) connected in parallel to P-channel output transistors Q1 and Q2 as first and second switching elements, respectively. That is, the output-stage circuit contains the output transistors Q1 and Q2, which function as first and second switching elements connected in series and alternately turned on and off, and the diodes D1 and D2 are connected between the source and drain of the transistors Q1 and Q2, respectively, such that the diodes D1 and D2 are opposite to the current direction of the output transistors Q1 and Q2. Then, a sawtooth current (also called a deflection current) is supplied to a vertical deflection coil Ly from the connection point between the output transistors Q1 and Q2 through a filter circuit 33 to be described later.

The drain of the output transistor Q1 is connected to the source of the output transistor Q2, the drain of the transistor Q2 is connected to the input terminal 17 of a negative power-supply voltage $-V_{ee}$, and the source of the transistor Q1 is connected to a pump-up circuit to be described later, which is composed of switching circuits S1 and S2, a charging capacitor $C_p$, a positive power-supply voltage $+V_{cc}$, and the negative power-supply voltage $-V_{ee}$.

The voltage at an output terminal 4 (that is, point B) is switched at high speed to the positive power-supply voltage $+V_{cc}$ or the negative power-supply voltage $-V_{ee}$ by the elements of the output transistors Q1 and Q2 and the diodes D1 and D2 during the scanning period. However, the absolute value of the power-supply voltages $+V_{cc}$ and $-V_{ee}$ is, for example, 15 V and, as described later, the voltage at point B is $V_{pu}$ during the flyback period. At the after stage of the output-stage circuit (Q1, D1, Q2, and D2) of the integrated circuit 30, the filter circuit 33 containing a smoothing circuit (integrating circuit) made of a choke coil $L_{ch}$ and a capacitor $C_i$ and a series circuit, connected in parallel to the capacitor $C_i$, made of a resistor $R_0$ and a capacitor $C_0$, is provided. A series circuit of the vertical deflection coil $L_y$ and a resistor $R_f$ is connected between the stage after the filter circuit 33 and the point of the reference potential. In the series circuit of the vertical deflection coil $L_y$ and the resistor $R_f$, a sawtooth current of a vertical cycle flows based on the integrated voltage of the filter circuit 33.

The resistor $R_f$ has a current-to-voltage conversion function in which the vertical sawtooth current flowing in the vertical deflection coil $L_y$ is changed into a voltage; that is, it has a current detection function.

Furthermore, an error amplifier 31, which outputs a difference voltage, that is, an error voltage between a sawtooth voltage V.SAW generated by a vertical sawtooth generating circuit 40 and a detection voltage (feedback voltage) generated at the resistor $R_f$, is provided. Moreover, a pulse width modulation and output-stage drive circuit (hereinafter, called a PWM/Drive) 32 for controlling the on/off operation of the output transistors Q1 and Q2 based on the error voltage from the error amplifier 31.

The sawtooth voltage V.SAW is input to an input terminal 13 of the integrated circuit (circuit shown by the alternate long and short dash line) 30 and the detection voltage (feedback voltage) generated in the resistor $R_f$ is input to a feedback-side input terminal 12 of the integrated circuit 30 through a feedback resistor $R_2$. Moreover, a parallel circuit made of a resistor $R_1$ and a capacitor $C_1$ is connected between an output terminal 14 (point C) and the input terminal 12 of the error amplifier 31 outside the integrated circuit 30.

The above-described pump-up circuit is connected to the source of the output transistor Q1, that is, one of the output transistors Q1 and Q2 which alternately operate in order to generate a sawtooth current (deflection current) and supply the current to the vertical deflection coil $L_y$. The pump-up circuit is provided between the terminals 5 and 6 of the integrated circuit 30 shown by the alternate long and short dash line outside the integrated circuit 30, and the pump-up circuit is constituted by the capacitor $C_p$ in which the total voltage of the absolute values of $+V_{cc}$ and $-V_{ee}$ is charged as a charging voltage, the switching circuit S1 which performs switching to point a on the $-V_{ee}$ side or point b on the $+V_{cc}$ side (that is, on the terminal 16 side) based on the error output of the error amplifier 31, and the switching circuit S2 which is turned on or off based on the error output of the error amplifier 31 and supplies $+V_{cc}$ as a power-supply voltage from the $+V_{cc}$ side to the source of the transistor Q1 and the capacitor $C_p$ when the switching circuit S2 is turned on. Moreover, the change of the error output of the error amplifier 31 is detected by a Schmitt circuit 34 and the switching circuits S1 and S2 are switched in accordance with the detection level.

That is, switching the switching circuit S1 to the $-V_{ee}$ side or the $+V_{cc}$ side and switching the switching circuit 2 to the on side or the off side are simultaneously performed by the switching instruction signal of high level or low level output from the Schmitt circuit 34 based on the error voltage $V_c$ from the error amplifier 31.

A Schmitt circuit, which is also called a Schmitt trigger, is a well known circuit and is a comparator in which a signal detection is performed by using different threshold levels at the first transition and last transition of an input signal. The threshold value at the first transition is set at a high value and, when the input signal is higher than the threshold value, a high level signal is output, and the threshold value of the last transition is set at a low value and, when the input signal is lower than the threshold value, a low level signal is output. In this way, an input waveform is shaped into a digital square waveform and the digital square waveform can be output.

In the Schmitt circuit 34, the error voltage $V_c$ of the error amplifier 31 is input to the minus terminal of an operational amplifier OP, the added voltage of a voltage $E_{R4}$ (voltage between both ends of a resistor $R_4$) obtained by dividing the output terminal voltage of the operational amplifier OP by the resistors $R_3$ and $R_4$ and a reference voltage $E_r$ is input to the plus terminal of the operational amplifier as a comparison reference voltage, and a comparison voltage is obtained by comparing the two input voltages in the operational amplifier OP, and thus the comparison voltage is used as a switching instruction signal to switch the switching circuits S1 and S2.

Furthermore, in the embodiment of the present invention, by switching the switching circuit S1, the voltage $V_D$ (see the waveform in FIG. 2F) of a pump-up pulse generated at a terminal 6 of the integrated circuit 30 is input to the input terminal 12 connected to the minus input terminal of the error amplifier 31 through a series circuit of a capacitor $C_x$ and a resistor Rx, that is, an impedance circuit 35. Thus, the pump-up pulse generated at the terminal 6 is differentiated by the impedance circuit 35, and the differentiated pump-up pulse is superposed on the feedback voltage from the feedback resistor $R_f$ to supply it to the input terminal 12 of the error amplifier 31. FIG. 2G shows the waveform of the voltage $V_E$ at the output point E of the impedance circuit 35. Thus, the response to the change in the pump-up operation becomes faster.

Next, the operation of the switching-type vertical deflection output circuit in FIG. 1 is described with reference to FIGS. 2A to 2G, 3, 4A, 4B, and 5. In FIGS. 2C, 2E, 4A, 4B, and 5, the dotted line in the waveforms shows improved portions in the waveform according to an embodiment of the present invention and the solid line shows the waveforms before improvement. Moreover, the waveform of the voltage $V_{Ly}$ in FIG. 2B shows a voltage waveform between both ends of the vertical deflection coil $L_y$.

In the circuit shown in FIG. 1, the reference sawtooth voltage V.SAW (for example, a 60 Hz-frequency sawtooth in the NTST television receiver) having a vertical cycle shown in FIG. 2A is input to the input terminal 13 of the integrated circuit 30. The voltage is amplified by the error amplifier 31 and is pulse-width modulated by the pulse-width modulation and output-stage drive circuit 32.

During the scanning period, the switching circuits S1 and S2 are in the state shown in the drawing (S1 is on the $-V_{ee}$ side and S2 is on the on side), the voltage of $-V_{ee}$ is applied to the terminal 6 and the $+V_{cc}$ voltage is applied to the terminal 5, and the capacitor $C_p$ is charged to the total voltage of the absolute values of $+V_{cc}$ and $-V_{ee}$.

Furthermore, during the scanning period, in the output-stage circuit (containing Q1, D1, Q2, and D2), the following two states 1 and 2 alternately arise. That is, in state 1, the transistor Q1 or the diode D1 is made conductive, the transistor Q2 and the diode D2 are made nonconductive, and the voltage of the output terminal 4 of the connection point of the transistors Q1 and Q2 (that is, the voltage $V_B$ at point B shown in FIG. 2D) is substantially equal to the positive power-supply voltage $+V_{cc}$. In state 2, the transistor Q1 and the diode D1 are made nonconductive, the transistor Q2 or the diode D2 is made conductive, and the voltage $V_B$ of the output terminal 4 is substantially equal to the negative power-supply voltage of $-V_{ee}$.

FIG. 3 shows an enlarged waveform of the voltage $V_B$ Of the terminal 4 during the scanning period in FIG. 2D. In the scanning period, the voltage $V_B$ at point B of the output terminal 4 produces a pulse voltage waveform in which the pulse widths are sequentially narrowed as the time passes, as shown in the lower drawing of FIG. 3, with the transistors Q1 and Q2 being on-off controlled by pulse-width modulated pulses. Then, the voltage $V_A$ at middle point A in the scanning period produces a sawtooth voltage in which the voltage level gradually decreases as shown in FIG. 2C by integrating the pulse voltage waveform by the integrating circuit made of the coil $L_{ch}$ and the capacitor $C_i$ in the post-filter circuit 33.

As described above, during the scanning period, in which the ratio between the continuing times of the two states 1 and 2 (which are called the duty ratio) changes, the voltage $V_A$ at middle point A changes as shown in FIG. 2C (that is, FIG. 4A) by the operation of the filter circuit 33, and the current $I_{Ly}$ flowing through the vertical deflection coil $L_y$ changes as shown in FIG. 4B. By the operation of the current detection resistor $R_f$, feedback resistor $R_2$, etc., the waveform of the current $I_{Ly}$ of the vertical deflection coil $L_y$ (see FIG. 4B) is substantially similar to the input sawtooth voltage V.SAW (see FIG. 2A).

FIG. 4A shows an enlarged waveform of the voltage $V_A$ at middle point A shown in FIG. 2C and FIG. 4B shows an enlarged waveform of the vertical deflection current $I_{Ly}$ flowing through the vertical deflection coil $L_y$.

During the flyback period, the state 1 continues and, even if the voltage $V_A$ at middle point A increases substantially to $+V_{cc}$, the vertical deflection current $I_{Ly}$ cannot completely change following the rapid change of the vertical periodical sawtooth voltage V.SAW (see FIG. 2A) and the voltage (error voltage) $V_c$ at output point C of the error amplifier 31 as a difference voltage between the vertical periodical sawtooth voltage V.SAW and the detection voltage at the resistor $R_f$ of the vertical deflection current $I_{Ly}$ greatly increases.

The voltage $V_c$ at output point C of the error amplifier 31 is shown in FIG. 2E. Furthermore, an enlarged waveform of the waveform in FIG. 2E is shown in FIG. 5. The switching circuits S1 and S2 are switched over therebetween by detecting the rapid increase of the error voltage Vc of the error amplifier 31 at the starting point of the flyback period by the Schumitt circuit 34 (the threshold value (that is, comparison voltage) of the positive terminal of the operational amplifier OP at this time is the pump-up starting level of $E_r$ plus $E_{R4}$ shown in FIG. 5). That is, at the start of the flyback period, the switching circuit S1 is switched from the $-V_{ee}$ side to the $+V_{cc}$ side and the voltage of $+V_{cc}$ is applied to the terminal 6. Furthermore, at this time, the switching circuit S2 is turned off and, since the capacitor $C_p$ is charged to the total voltage of the absolute values of $+V_{cc}$ and $-V_{ee}$, the total voltage of twice +Vcc and the absolute value of $-V_{ee}$ (hereinafter, referred to as $V_{pu}$) is applied to the terminal 5 and, since the transistor Q1 or the diode D1 is made conductive, the voltage substantially equal to the voltage to the terminal 5 is output to the terminal 4. In this way, since the voltage $V_A$ at point A increases, the flyback period can be finished in a short time.

The pump-up operation is finished by detecting the error voltage $V_c$ from the error amplifier 31 decreased to the level equal to that during the scanning period. That is, by detecting a drop of the rapidly increasing waveform of the error voltage $V_c$ of the error amplifier 31 at the end of the flyback period by Schmitt circuit 34 (the threshold value, that is, comparison reference voltage, of the operational amplifier OP at this time is the pump-up finishing level of $(E_r-E_{R4})$ as shown in FIG. 5), the switching circuit S1 is switched to the $-V_{ee}$ side and the switching circuit S2 is switched on. After the end of the pump-up period, the duty ratio of the output-stage circuit (Q1, D1, Q2, and D2) is changed again by the error voltage $V_c$ to restart the operation following the input sawtooth voltage V.SAW.

However, up to now, the voltage $V_B$ at the output terminal 4, that is, at point B rapidly decreases from $V_{pu}$ to $+V_{cc}$ by finishing the pump-up operation just before restarting the following operation, and this causes disturbance to the feedback loop by the feedback resistor $R_f$.

On the other hand, in the switching-type vertical deflection output circuit, a signal having frequency components over the switching frequency cannot pass through the output-stage circuit in principle. As a matter of course, when the component of the switching frequency is contained in the deflection current of the vertical deflection coil $L_y$, since it appears as noise on the screen, the pass band is limited by the filter circuit 33. Furthermore, except for that, the influence of the component of crosstalk from the horizontal winding (not illustrated) of the deflection yoke, etc., may appear and the band restriction by means of the capacitor C1, etc., is often performed in the error amplifier 31, too. Because of these operations, after the occurrence of disturbance to the feedback loop due to the completion of the pump-up operation, it takes time to settle, and, in some cases, the disturbance appears on the screen as the change in the density of scanning lines in the upper portion of the screen.

In order to solve such conventional problems, in the embodiment of the present invention, the pump-up pulse generated at the connection point of the capacitor $C_p$ and the switching circuit S1, that is, at the terminal 6 of the integrated circuit 30, is supplied to the input terminal 12 of the error amplifier 31 through the series circuit of a capacitor $C_x$ and a resistor $R_x$. In this way, only the component of disturbance due to the completion of the pump-up operation can be added to the negative feedback input of the error amplifier 31 without making the disturbance component pass through the filter circuit 33, it is possible to speed up the response to the disturbance component, and the change of the density of scanning lines can be greatly reduced in the visible area of the screen.

Moreover, in FIG. 1, although the pump-up pulse is obtained from the terminal 6, the pump-up pulse may be obtained from the terminal 5 and, even if the pump-up pulse is obtained from the voltage of the terminal 4 through a comparator, etc., the same effect can be obtained. Furthermore, the impedance circuit 35 between the pulse source for the pump-up pulse and the input terminal of the error amplifier 31 is not limited to a series circuit of a capacitor and a resistor. Moreover, as a matter of course, the present invention can be applied to cases where integrated circuits except STV9380 are used as the integrated circuit 30, and the impedance circuit 35 may be put in the integrated circuit 30 in advance.

Figure 6:
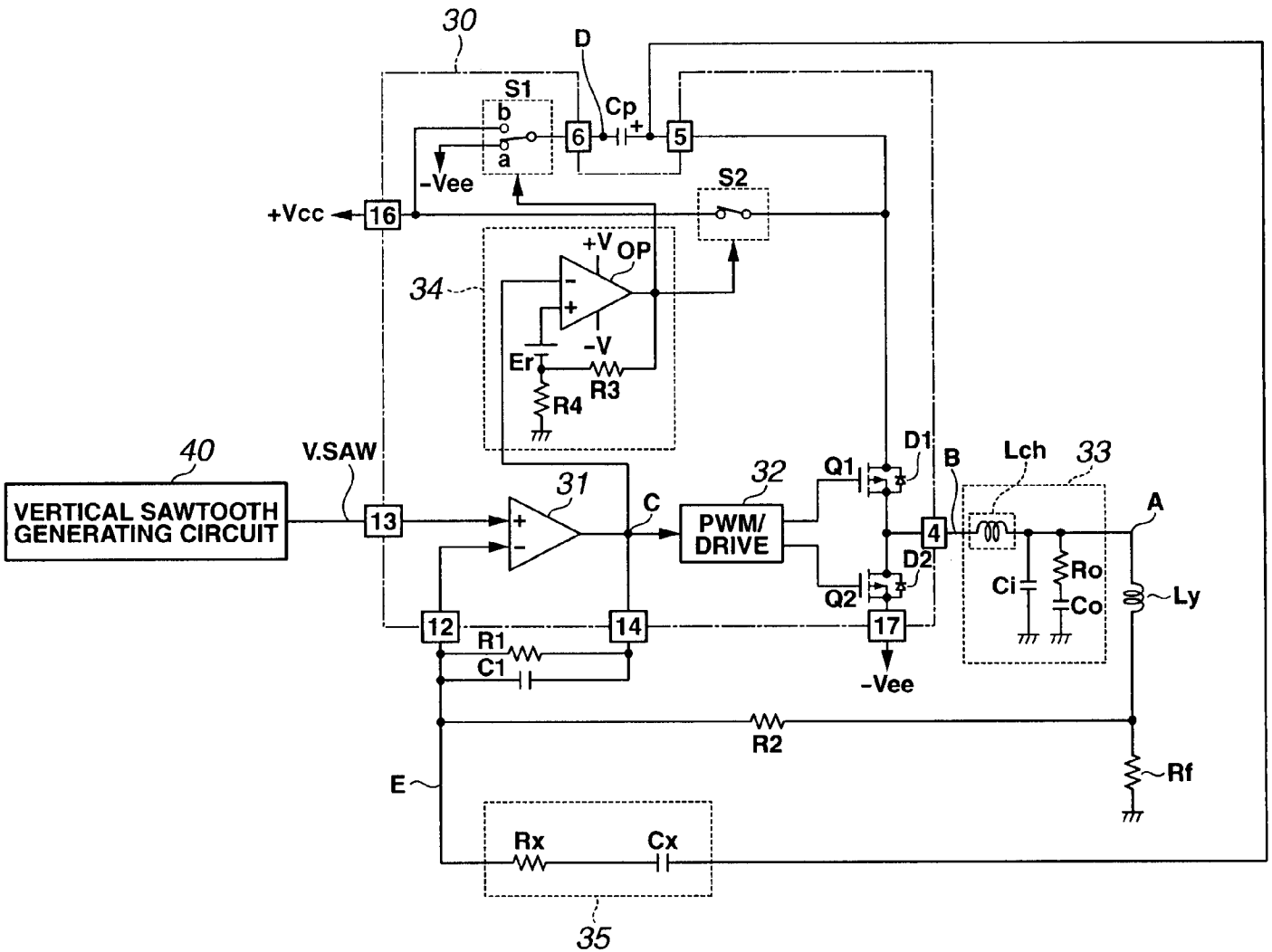
FIG. 6 is the circuit diagram of a switching-type vertical deflection output circuit of another embodiment of the present invention.

FIG. 6 shows the circuit diagram of a switching-type vertical deflection output circuit according to another embodiment of the present invention.

In FIG. 6, the pump-up pulse to be supplied to the impedance circuit 35 is obtained from the connection point, that is, the terminal 5 of the charging capacitor $C_p$ and the output transistor Q1 as a first switching element. The other construction is the same as in FIG. 1. The operational effect is also the same as in FIG. 1.

Figure 7:
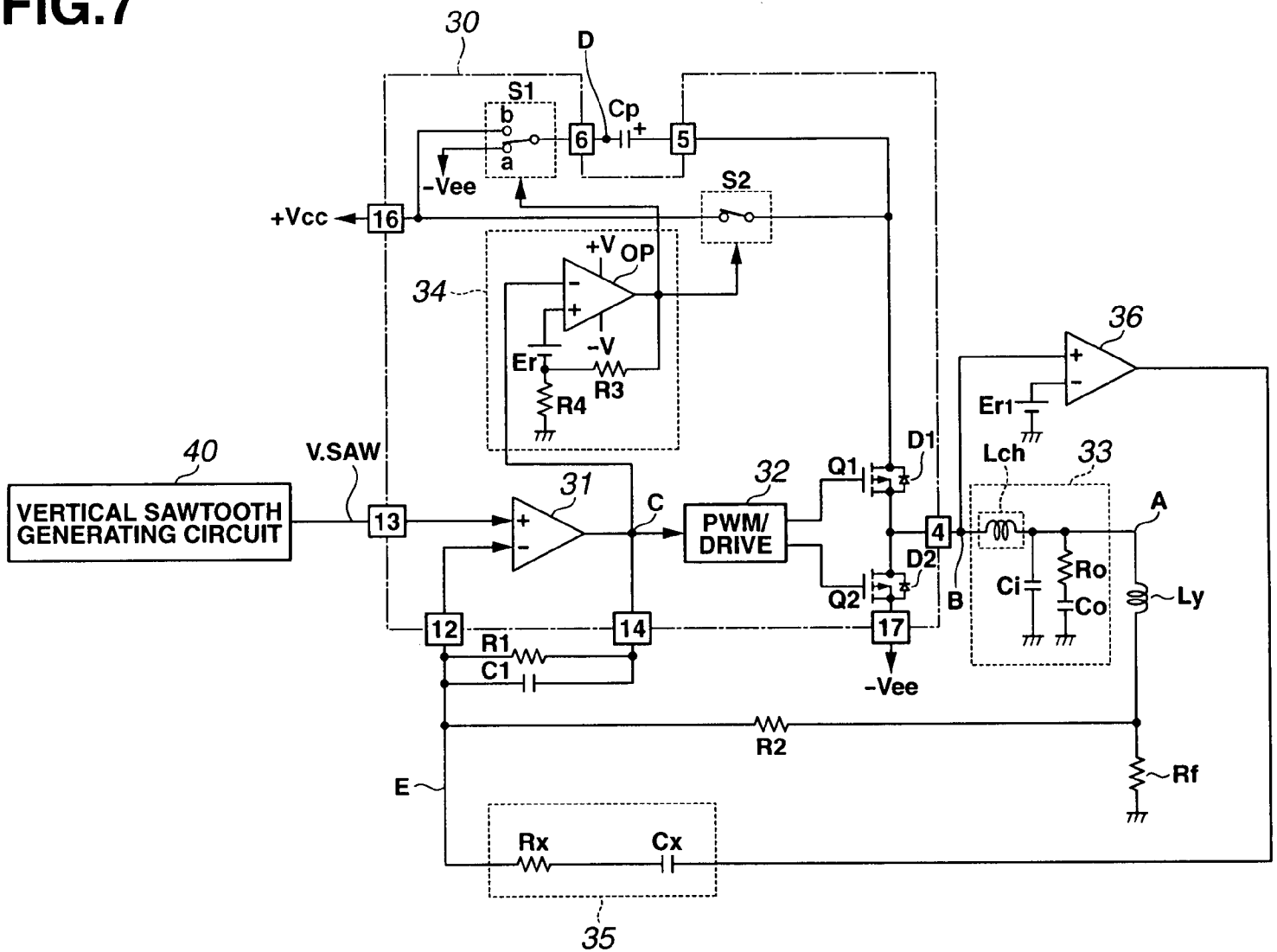
FIG. 7 is the circuit diagram of a switching-type vertical deflection output circuit of another embodiment of the present invention.

FIG. 7 shows the circuit diagram of a switching-type vertical deflection output circuit according to another embodiment of the present invention.

In FIG. 7, the vertical deflection output circuit is constructed so that the pump-up pulse to be supplied to the impedance circuit 35 may be obtained from the voltage of the terminal 4, which is the output point of the output-stage circuit, through a comparator 36. The voltage of the terminal 4 is input to the positive terminal of the comparator 36 and a reference voltage $E_{r1}$ $(+V_{cc}<E_{r1}<V_{pu})$ is input to the negative terminal of the comparator 36. When the voltage $V_B$ at point B shown in FIG. 2D exceeds the reference voltage $E_{r1}$, a comparison pulse signal is output from the comparator 36 and supplied to an impedance circuit 35. The other construction is the same as in FIG. 1. The operational effect is the same as in FIG. 1.

According to the present invention described above, even if the vertical deflection circuit is integrated, the addition of only a simple circuit can improve the waveform.

Having described the preferred embodiments of the invention referring to the accompanying drawings, it should be understood that the present invention is not limited to those precise embodiments and various changes and modifications thereof could be made by one skilled in the art without departing from the spirit or scope of the invention as defined in the appended claims.

What is claimed is:

1. A switching-type vertical deflection output circuit comprising:

an output-stage circuit in which the anode of a first diode is connected to the cathode of a second diode, the cathode of the first diode is connected to a first power supply, the anode of the second diode is connected to a second power supply as a reference potential or a low potential including negative voltage, and first and second switching elements are connected in parallel to the first and second diodes, respectively;

a smoothing circuit which smoothes the voltage at the connection point of the first and second switching elements;

a vertical deflection coil to which a smoothed voltage is supplied from the smoothing circuit;

a unit which generates a vertical sawtooth voltage as a reference;

a voltage conversion unit which converts a current flowing in the vertical deflection coil to a voltage;

an error voltage generation unit which generates an error voltage between the vertical sawtooth voltage and a voltage converted by the voltage conversion unit thereto;

a drive unit which controls the on/off operation of the first and second switching elements in the output-stage circuit by generating a drive pulse of a duty ratio in accordance with the error voltage from the error voltage generation unit;

a pump-up circuit which pumps up the power-supply voltage of the first power supply to be supplied to the connection point of the first switching element and the cathode of the first diode in the output-stage circuit during the flyback period by detecting the level of the error voltage from the error voltage generation unit; and an impedance circuit which supplies a pump-up pulse generated based on the pump-up operation of the pump-up circuit to an input terminal for the conversion voltage from the voltage conversion unit in the error voltage generation unit.

2. A switching-type vertical deflection output circuit as claimed in claim 1, the pump-up circuit further comprising:

a first switching unit which selects either of the first power supply and the second power supply generating a higher voltage than the voltage generated by the first power supply in accordance with the detection level of the error voltage from the error voltage generation unit;

a charging capacitor of which the negative terminal is connected to the output terminal of the first switching unit and of which the positive terminal is the connection point of the first switching element and the cathode of the first diode; and a second switching unit of which one end is connected to the second power supply, of which the other end is connected to the connection point of the first switching element and the cathode of the first diode, and is simultaneously turned on or off, when the first switching unit is switched, in accordance with the detection level of the error voltage from the error voltage generation unit.

3. A switching-type vertical deflection output circuit as claimed in claim 1, wherein the impedance circuit is a series circuit of a capacitor and a resistor.

4. A switching-type vertical deflection output circuit as claimed in claim 2, wherein the impedance circuit is a series circuit of a capacitor and a resistor.

5. A switching-type vertical deflection output circuit as claimed in claim 2, wherein a pump-up pulse to be supplied to the impedance circuit is obtained from the connection point of the first switching unit and the charging capacitor.

6. A switching-type vertical deflection output circuit as claimed in claim 2, wherein a pump-up pulse to be supplied to the impedance circuit is obtained from the connection point of the charging capacitor and the first switching element.

7. A switching-type vertical deflection output circuit as claimed in claim 1, wherein a pump-up pulse to be supplied to the impedance circuit is obtained based on the output point voltage of the output-stage circuit.

8. A switching-type vertical deflection output circuit as claimed in claim 2, wherein a pump-up pulse to be supplied to the impedance circuit is obtained based on the output point voltage of the output-stage circuit.

9. A vertical deflection drive circuit for operating a vertical deflection coil, comprising:

a unit which converts a current flowing in the deflection coil to a voltage, a generation unit which generates an error voltage between a voltage of an input saw-tooth signal and the coil voltage, a drive unit which generates a drive pulse of a duty ratio in accordance with the error voltage, an output circuit which is connected to a power supply and produces a drive signal in accordance with the drive pulse, a pump-up circuit which pumps up a voltage of the power supply to be supplied to the output circuit during a fly back period, a superpose circuit which supplies a pump-up pulse which is generated by the pumped up voltage to the generation unit together with the coil voltage.

10. A vertical deflection drive circuit as claimed in claim 9, wherein the superpose circuit is a series circuit of a capacitor and a resistor.

11. A vertical deflection drive circuit as claimed in claim 9, wherein the drive unit comprising:

a first diode and, a second diode, wherein anode of the first diode is connected to the cathode of the second diode, the cathode of the first diode is connected to a first power supply, the anode of the second diode is connected to a second power supply as a reference potential or a low potential including negative voltage, and first and second switching elements are connected in parallel to the first and second diodes, respectively.

* * * * *